US008106590B2

(12) United States Patent
Hendricx et al.

(10) Patent No.: US 8,106,590 B2
(45) Date of Patent: Jan. 31, 2012

(54) VEHICLE HEADLAMP

(75) Inventors: Josephus Christiaan Maria Hendricx, Eindhoven (NL); Marinus Cornelis Raas, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 318 days.

(21) Appl. No.: 10/598,261

(22) PCT Filed: Mar. 1, 2005

(86) PCT No.: PCT/IB2005/050749

§ 371 (c)(1),
(2), (4) Date: Aug. 23, 2006

(87) PCT Pub. No.: WO2005/088673

PCT Pub. Date: Sep. 22, 2005

(65) Prior Publication Data

US 2007/0164679 A1 Jul. 19, 2007

(30) Foreign Application Priority Data

Mar. 8, 2004 (EP) ..... 04100921
Mar. 8, 2004 (EP) ..... 04100924

(51) Int. Cl.
*H01J 17/20* (2006.01)
*H01J 61/20* (2006.01)
*H01J 61/16* (2006.01)

(52) U.S. Cl. ..... 313/640; 313/643

(58) Field of Classification Search ..... 313/17, 313/637, 567, 643

See application file for complete search history.

(56) References Cited

U.S. PATENT DOCUMENTS

| | | | | |
|---|---|---|---|---|
| 7,245,075 | B2 * | 7/2007 | Chen et al. | 313/576 |
| 7,268,495 | B2 * | 9/2007 | Rintamaki et al. | 313/640 |
| 2002/0185973 | A1 * | 12/2002 | Jackson et al. | 313/607 |
| 2003/0015949 | A1 * | 1/2003 | Higashi et al. | 313/17 |
| 2003/0102808 | A1 * | 6/2003 | Dakin et al. | 313/640 |
| 2004/0095076 | A1 * | 5/2004 | Kastle et al. | 315/209 R |

FOREIGN PATENT DOCUMENTS

| | | | |
|---|---|---|---|
| EP | 0587238 | A1 | 3/1994 |
| WO | WO0115205 | A1 | 3/2001 |

* cited by examiner

*Primary Examiner* — Toan Ton
*Assistant Examiner* — Zachary Snyder

(57) ABSTRACT

Metal halide lamp suitable as projection lamp, for instance as a vehicle headlamp comprising a discharge vessel surrounded by an outer envelope with clearance and having a ceramic wall which encloses a discharge space filled with a filling comprising an inert gas, such as xenon (Xe), and an ionizable salt, wherein in said discharge space two electrodes are arranged whose tips have a mutual interspacing so as to define a discharge path between them, with the special feature that said ionizable salt comprises NaI, TlI, $CaI_2$ and $XI_3$ wherein X is selected from the group comprising rare earth metals.

15 Claims, 1 Drawing Sheet

VEHICLE HEADLAMP

Figure 1:
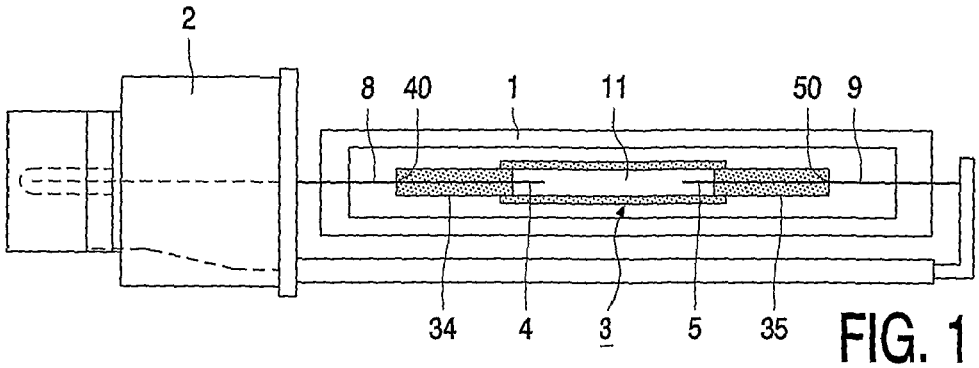

The present invention relates to a metal halide lamp suitable as projection lamp, for instance as a vehicle headlamp comprising a discharge vessel surrounded by an outer envelope with clearance and having a ceramic wall which encloses a discharge space filled with a filling comprising an inert gas, such as xenon (Xe), and an ionizable salt, wherein in said discharge space two electrodes are arranged whose tips have a mutual interspacing so as to define a discharge path between them.

In this description and these claims the ceramic wall is understood to mean both a wall of metal oxide such as, for example, sapphire or densely sintered polycrystalline $Al_2O_3$ and metal nitride, for example, AlN. According to the state of the art these ceramics are well suited to form translucent discharge vessel walls.

Such a metal halide lampis generally known, in particular as projection lamp, more specific as a vehicle headlamp. Both electrodes are each supported by a current conductor entering the discharge vessel. The current conductors consist of a first part made of an halide resistant material, such as a Mo—$Al_2O_3$ cermet, and a second part made of niobium. Niobium is chosen because this material has a coefficient of thermal expansion corresponding to that of the discharge vessel in order to prevent leakage of the headlamp.

Disadvantages of the known metal halide lamp are the following. A central part of the discharge vessel thereof has on both sides narrow end parts or extended plugs (i.e. elongated end parts) connected to the central part of the discharge vessel, which enclose the current conductors. However, as said plugs are remote from the discharge path, they function as cooling fins, so that part of the lamp filling (i.e. salts) may condense in a void between each current conductor and the (wall of the) extended plugs. Said condensation may lead to color instability of the metal halide lamp, which is disadvantageous particular when applied as projection lamp. De-mixing of salt components generally is disadvantageous as it leads to color instabilities (for example, if the filling contains NaCe-iodide, more Na than Ce will creep into said voids). In order to obtain a light efficacy as high as possible, preferably rare earth metal iodides as $CeI_3$, $PrI_3$, $LuI_3$ and/or $NdI_3$ are added to the filling. However, these salts especially if larger mole fractions are applied are aggressive and will easily result in attack of the ceramic wall of the discharge vessel. What is more, said wall attack—close to the discharge path—will lead to scattering/absorbing of light with all disadvantageous consequences for the light distribution. Finally, the light output as function of time should be as stable as possible. However, if salt reacts with other lamp parts and thus disappears, for example, said light output (and thus maintenance) will drop.

It is an object of the invention to obviate these disadvantages, particularly to propose a metal halide lamp operating in such a way that said corrosion of the (wall of the) extended plugs and said color instability are counteracted.

In order to accomplish that objective a metal halide lamp of the type referred to in the introduction according to the invention is characterized in that said ionizable salt comprises NaI, TlI, $CaI_2$ and $XI_3$, wherein X is selected from the group comprising rare earth metals. Preferably, X is selected from the group comprising Ce, Pr, Lu, Nd, that is cerium, praseodymium, lutetium and neodymium. Extensive research has surprisingly shown that salt mixtures comprising NaI, TlI, $CaI_2$ and $XI_3$ are hardly aggressive and only slightly sensitive for large variations in lamp power and thus in coldest spot temperature, for example at the location of the voids mentioned above, and these salt mixtures exhibit relatively less tendency to segregation, i.e. changes in salt mix ratio at the coldest spot due to for instance corrosion or transport of said salts, and thus making the lamp relatively insensitive for color shifts due to segregation. For completeness' sake it is noted that Na, Tl, Ca and I stand for natrium, thallium, calcium and iodine, respectively.

In a preferred embodiment of a metal halide lamp in accordance with the invention X is Ce, wherein the molar percentage ratio $CeI_3/(NaI+TlI+CaI_2+CeI_3)$ lies between 0 and 10%, in particular between 0.5 and 7%, more in particular between 1 and 6. Preferably, in a further embodiment with X is Ce, the molar percentage ratio $CaI_2/(NaI+TlI+CaI_2+CeI_3)$ lies between 20 and 90%, in particular between 35 and 85%, more in particular between 45 and 80%.

In another preferred embodiment of a metal halide lamp according to the invention the amount of NaI, TlI, $CaI_2$ and $XI_3$ lies between 0.005 and 0.5 g/cm$^3$, in particular between 0.025 and 0.3 g/cm$^3$. The volume of the discharge vessel particularly ranges between 0.008 and 0.009 cm$^3$.

In a preferred embodiment of a metal halide lamp in accordance with the invention the filling comprises mercury (Hg). In an alternative, the lamp filling is mercury-free.

The invention also relates to a metal halide lamp according to the invention being used as projection lamp, in particular in a vehicle headlamp.

Figure 2:
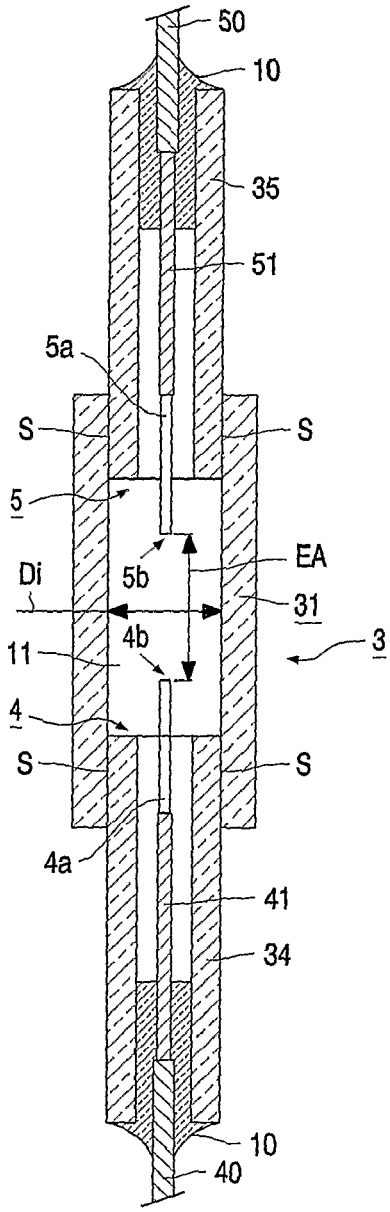

The invention will now be explained in more detail with reference to Figures illustrated in a drawing, wherein FIG. 1 shows a preferred embodiment of a metal halide lamp according to the invention in a side elevation; and FIG. 2 shows the discharge vessel of the metal halide lamp of FIG. 1 in detail.

FIG. 1 shows a metal halide lamp provided with a discharge vessel 3 having a ceramic wall which encloses a discharge space 11 containing an ionizable filling. Two tungsten electrodes 4, 5 whose tips 4*b*, 5*b* are at a mutual distance EA are arranged in the discharge space, and the discharge vessel has an internal diameter Di at least over the distance EA. The discharge vessel is closed at one side by means of a ceramic protruding plug 34, 35 which encloses a current lead-through conductor (FIG. 2: 40,41,50,51) to an electrode 4,5 positioned in the discharge vessel with a narrow intervening space and is connected to this conductor in a gas tight manner by means of a melting-ceramic joint (FIG. 2: 10) at an end remote from the discharge space. The discharge vessel is surrounded by an outer bulb 1 which is provided with a lamp cap 2 at one end. A discharge will extend between the electrodes 4,5 when the lamp is operating. The electrode 4 is connected to a first electrical contact forming part of the lamp cap 2 via a current conductor 8. The electrode 5 is connected to a second electrical contact forming part of the lamp cap 2 via a current conductor 9. The discharge vessel, shown in more detail in FIG. 2 (not true to scale), has a ceramic wall and is formed from a cylindrical part with an internal diameter Di which is bounded at either end by a respective ceramic protruding plug 34,35 which is fastened in a gas tight manner in the cylindrical part by means of a sintered joint S. The ceramic protruding plugs 34,35 each narrowly enclose a current lead-through conductor 40,41,50,51 of a relevant electrode 4,5 having a tip 4*b*, 5*b*. The current lead-through conductor is connected to the ceramic protruding plug 34,35 in a gas tight manner by means of a melting-ceramic joint 10 at the side remote from the discharge space. The electrode tips 4*b*, 5*b* are arranged at a mutual distance EA. The current lead-through conductors each comprise a halide-resistant portion 41,51, for example in the form of a Mo—$Al_2O_3$ cermet and a portion 40,50 which is fastened to a respective end plug 34,35 in a gas tight manner by means of the melting-ceramic joint 10. The melting-ceramic joint extends over some distance, for example approximately 1 mm, over the Mo cermet 40,41. It is possible for the parts 41,51 to be formed in an alternative manner instead of from a Mo—$Al_2O_3$ cermet. Other possible constructions are known, for example, from EP 0 587 238. A particularly suitable construction was found to be a halide-resistant material. The parts 40,50 are made from a metal whose coefficient of expansion corresponds very well to that of the end plugs. Nb, for example, is for this purpose a highly suitable material. The parts 40,50 are connected to the current conductors 8,9 in a manner not shown in any detail. Each of the electrodes 4,5 comprises an electrode rod 4*a*,5*a* which is provided with a tip 4*b*,5*b*.

In a practical realization of the metal halide lamp as represented in the drawing a number of lamps were manufactured with a rated power of 30 W each. The lamps are for use as headlamps for a motor vehicle. The ionizable filling of the discharge vessel 3 of each individual lamp comprises 100 mg/$cm^3$ iodide, comprising NaI, TlI, $CaI_2$ and $CeI_3$. The filling further comprises Xe with a filling pressure at room temperature of 16 bar. The distance EA between the electrode tips 4*a*,5*a* is 4 mm, the internal diameter Di is 1.3 mm, so that the ration EA/Di=3.1. The wall thickness of the discharge vessel 3 is 0.4 mm.

The invention claimed is:

1. A lamp comprising:

a discharge vessel having a volume that lies between 0.008 and 0.009 $cm^3$;

an outer envelope surrounding the discharge vessel and having a ceramic wall which encloses a discharge space filled with a filling comprising an inert gas, and an ionizable salt; and two electrodes arranged in the discharge space having tips with a mutual interspacing so as to define a discharge path between the tips;

said ionizable salt consisting of NaI, TlI, $CaI_2$ and $XI_3$, wherein X is selected from the group consisting of rare earth metals and wherein the amount of NaI, TlI, $CaI_2$ and $XI_3$ lies between 0.025 and 0.3 g/$cm^3$.

2. The lamp according to claim 1, wherein X is selected from the group consisting of Pr, Lu, Nd.

3. The lamp according to claim 1, wherein X is Ce and wherein the molar percentage ratio $CeI_3$/(NaI+TlI+$CaI_2$+$CeI_3$) lies between 0.5 and 7%.

4. The lamp according to claim 1, wherein the filling comprises Hg.

5. A lamp comprising:

a discharge vessel;

an outer envelope surrounding the discharge vessel and having a ceramic wall which encloses a discharge space filled with a filling comprising an inert gas, and an ionizable salt; and two electrodes arranged in the discharge space having tips with a mutual interspacing so as to define a discharge path between the tips;

said ionizable salt consisting of NaI, TlI, $CaI_2$ and $CeI_3$, and a molar percentage ratio $CaI_2$/(NaI+TlI+$CaI_2$+$CeI_3$) lies between 50 and 90%.

6. The lamp according to claim 5, wherein the molar percentage ratio $CaI_2$/(NaI+TlI+$CaI_2$+$CeI_3$) lies between 70 and 90%.

7. The lamp according to claim 2, wherein the filling comprises Hg.

8. The lamp according to claim 3, wherein the filling comprises Hg.

9. The lamp according to claim 1, wherein the filling comprises Hg.

10. The lamp according to claim 5, wherein the filling comprises Hg.

11. The lamp according to claim 1, wherein a rated power of the lamp is 30 W.

12. The lamp according to claim 3, wherein a rated power of the lamp is 30 W.

13. The lamp according to claim 5, wherein the molar percentage ratio $CaI_2$/(NaI+TlI+$CaI_2$+$CeI_3$) lies between 60 and 90%.

14. The lamp according to claim 5, wherein a rated power of the lamp is 30 W.

15. The lamp according to claim 5, wherein the molar percentage ratio $CaI_2$/(NaI+TlI+$CaI_2$+$CeI_3$) lies between 80 and 90%.

* * * * *